US006367557B1

(12) United States Patent
Rosine et al.

(10) Patent No.: US 6,367,557 B1
(45) Date of Patent: Apr. 9, 2002

(54) TAPERED CONNECTOR FOR A TUBING STRING

(75) Inventors: Randy S. Rosine, Duncan, OK (US); John R. Martin, Houston, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/599,337

(22) Filed: Jun. 22, 2000

(51) Int. Cl.[7] ..... E21B 19/22
(52) U.S. Cl. ..... 166/384; 166/77.2; 166/85.1
(58) Field of Search ..... 166/77.1–77.3, 166/85.5, 85.1, 384

(56) References Cited

U.S. PATENT DOCUMENTS 4,515,220 A * 5/1985 Sizer et al. ..... 166/384
5,094,340 A * 3/1992 Avakov ..... 198/626.1
5,435,395 A 7/1995 Connell ..... 166/384
5,454,419 A * 10/1995 Vloedman ..... 166/277
5,553,668 A 9/1996 Council et al. ..... 166/77.3
5,626,192 A 5/1997 Connell et al. ..... 166/255.1
5,704,393 A 1/1998 Connell et al. ..... 137/614.21
6,230,955 B1 * 5/2001 Parks ..... 226/190

* cited by examiner

*Primary Examiner*—David Bagnell
*Assistant Examiner*—Zakiya Walker
(74) *Attorney, Agent, or Firm*—John W. Wustenberg; Neal R. Kennedy

(57) ABSTRACT

A tapered connector for a tubing string. The present invention includes a tapered connector used in interconnecting sections of the tubing string having differing outside diameters. The connector is preferably conical and fixedly attached to the tubing portions in various ways, such as welding. The tubing string can be injected into a well by using a tubing injector with gripper blocks having a V-shaped groove defined therein adapted for engaging the different diameter tubing sections and the tapered connector and methods of injecting are also disclosed.

21 Claims, 2 Drawing Sheets

TAPERED CONNECTOR FOR A TUBING STRING

BACKGROUND OF THE INVENTION

1. Field of the Invention

This invention relates to the use of coiled tubing in a well, and more particularly, to a tapered connector for joining lengths of coiled tubing with differing outside diameters.

2. Description of the Prior Art

After a well has been completed to produce oil or gas, it is necessary to periodically service the well. There are many occasions where the service procedure is carried out using coiled tubing. Such tubing is inserted into the wellhead through a lubricator assembly or stuffing box. Typically, this is necessary because there is a pressure differential at the surface of the well and the atmosphere, which may have been naturally or artificially created, that serves to produce oil or gas or a mixture thereof from the pressurized well. The tubing is inserted by an injector which generally incorporates a tubing guide, or gooseneck, and a plurality of gripper blocks for engaging the tubing and moving it through the injector. One such injector apparatus is shown in U. S. Pat. No. 5,553,668, assigned to the assignee of the present invention.

The tubing is relatively flexible and can therefore be cyclically coiled onto and off of a spool, or reel, by the injector which often acts in concert with a windlass and a power supply which drives the spool or reel. In the injector, the gripper blocks are attached to movable gripper chains. The gripper blocks sequentially grip the coiled tubing that is positioned therebetween. When the gripper chains are in motion, each chain has a gripper block that is coming in contact with the coiled tubing as another gripper block on the same gripper chain is breaking contact with the coiled tubing. This continues in an endless fashion as the gripper chains are driven to force the tubing into or out of the wellbore, depending on the direction in which the drive sprockets are rotated.

In the past, such coiled tubing has had a constant cross section. However, maintaining a constant diameter for the tubing can present some problems under certain circumstances. For example, it may be desirable to reduce the weight of the string, and this cannot be done if the string has a constant diameter. Further, a larger string causes more drag in the wellbore, particularly when the strings are being used in a horizontal or other deviated portion of the well. There is a need, therefore, for a tubing string with different sized portions. The present invention provides a solution to this problem by providing a string having a tapered connection therein between two lengths of tubing having differing diameters. This is accomplished by providing a tapered connector which provides an elongated tapering tubing string portion which is connected at opposite ends thereof to a larger tubing portion and a smaller tubing portion.

For example, a larger outside diameter tubing at the top of the string and a smaller outside diameter tubing at the bottom allow the coiled tubing string to be designed for longer lengths by reducing the hanging weight of the string and also reduces the percent of yield load on the larger diameter portion compared to a string having a single outside diameter.

The present invention also provides for use of a smaller outside diameter portion in a horizontal or deviated well formation, thus reducing the drag of the tubing while still having the larger diameter portion at the top of the string to push the string further into the well because of the decreased buckling of the large portion.

Another problem with constant diameter tubing relates to the key issue of pressure drop therethrough. If the wellbore size at the treatment area is small, then previously a small diameter length of tubing had to be used. The smaller diameter tubing could present significant pressure drop problems. The present invention solves this by allowing the use of larger outside diameter tubing close to the treatment zone with a smaller portion actually at the treatment zone.

All of these embodiments are possible due to the V-shaped groove design of the gripper blocks in the Halliburton injector system which allows tubing of varying outside diameters to be engaged by the same blocks.

SUMMARY OF THE INVENTION

The apparatus of the present invention utilizes one or more tapered connectors in a tubing string for use in servicing a well. Thus, the invention provides a tubing string for use with a tubing injector for injecting tubing into a wellbore wherein the string comprises at least a first tubular portion having a first tubing outside diameter, a second tubular portion having a second tubing outside diameter which is different than the first tubing outside diameter, and a tapered portion disposed between the first and second tubing portions. The tapered portion comprises a first end having a first end outside diameter substantially equal to the first tubing outside diameter and a second end having a second end outside diameter substantially equal to the second tubing outside diameter. The tapered portion is preferably substantially conical.

The tapered portion may be connected to the first and second tubing portions by a variety of means. For example, it can be crimped, swaged, screwed or welded to the connection. A first connector may be used interconnecting the first tubing portion and the first end of the tapered portion, and a second connector may be used interconnecting the second tubing portion and the second end of the tapered portion. These first and second connectors may be integrally formed with the tapered portion. Multiple tapered portions with connectors may be utilized in a tubing string to connect differing diameter tubings into a string for servicing a well.

In the preferred embodiment, the first and second connectors are substantially cylindrical. The first connector has a first connector outside diameter substantially equal to the first tubing outside diameter, and the second connector has a second connector outside diameter substantially equal to the second tubing outside diameter.

The present invention also includes a method of running tubing in a wellbore comprising the steps of (a) providing a tubing string having an outer surface with a plurality of outside diameters, and (b) injecting this tubing string into the wellbore. Step (a) comprises providing the tubing string with a tapered connector between adjacent tubing portions having different outside diameters. Step (b) comprises passing the tapered connector through a tubing injector for injecting the tubing into the wellbore. This injector is provided with a plurality of gripper blocks therein adapted for engaging and gripping the tapered connector and the different outside diameters of the tubing string as the tubing string is injected into the wellbore.

Stated in another way, the invention includes a method of running tubing into a wellbore comprising the steps of (a) positioning a tubing injector adjacent to a wellhead at an upper end of a wellbore, (b) positioning a tubing string through the injector, the tubing string being provided with an outer surface having more than one outside diameter, and (c) actuating the tubing injector for injecting the tubing string in the wellbore. Step (c) may include passing a tubing connector therethrough which interconnects the portions of the tubing string having different outside diameters.

Numerous objects and advantages of the invention will become apparent with the following detailed description of the preferred embodiment is read in conjunction with the drawings illustrating such embodiment.

DESCRIPTION OF THE PREFERRED EMBODIMENT

Figure 1:
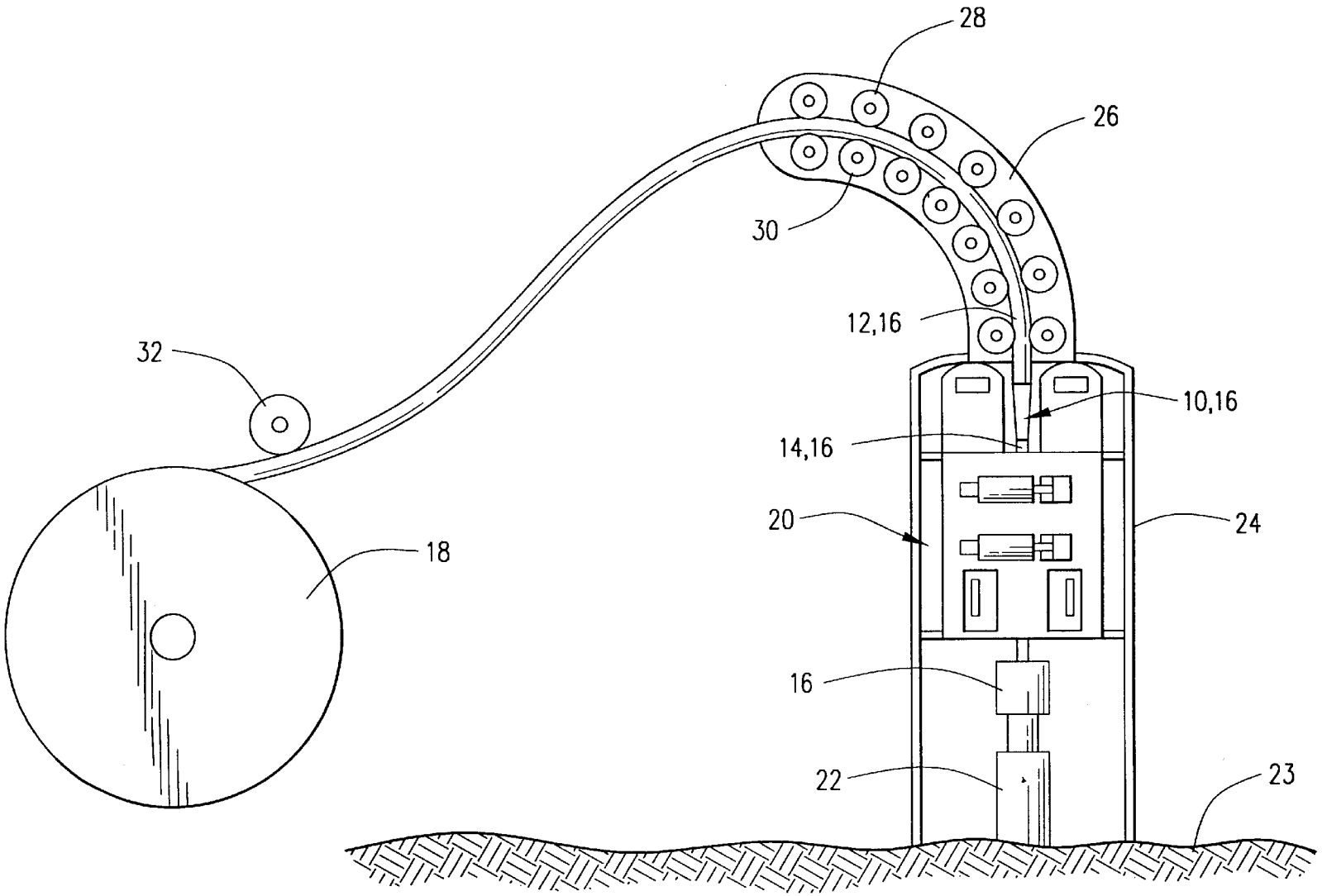
FIG. 1 schematically shows the tubing connector of the present invention interconnecting two portions of a tubing string having different outside diameters as the tubing string is passed through a tubing injector into a well.
Figure 2:
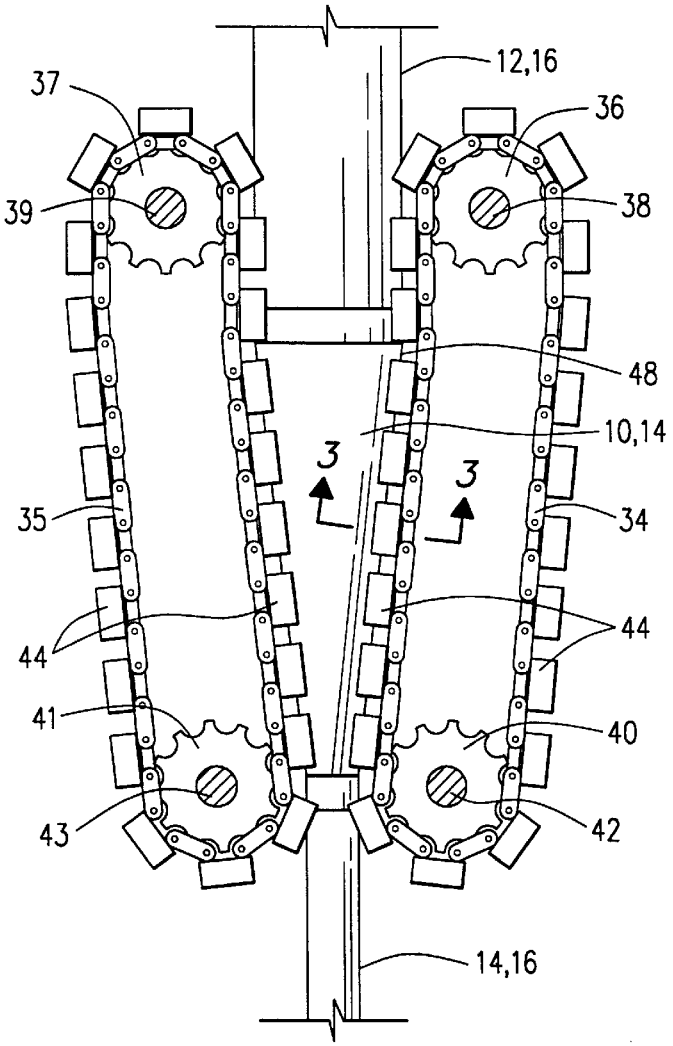
FIG. 2 shows a detail of the engagement of gripper blocks in the tubing injector with the tubing string.

Referring now to the drawings, and more particularly to FIGS. 1 and 2, the tubing connector of the present invention is shown and generally designated by the numeral 10. Connector 10 interconnects a first tubing section or portion 12 and a second tubing section or portion 14. First tubing section 12, second tubing section 14 and tubing connector 10 may all be said to form portions of a tubing string 16.

Typically, tubing string 16 is supplied on a large drum or reel 18 and is typically several thousand feet in length. Tubing string 16 is in a relaxed but coiled state when supplied from drum 18. Tubing string 16 is typically spooled from the drum 18 supported on a truck (not shown) for mobile operations.

An injector apparatus 20 is mounted above a wellhead 22 adjacent to a ground surface 23 on a superstructure 24. Extending upwardly and away from superstructure 24 is a guide framework 26 having a plurality of pairs of guide rollers 28 and 30 rotatably mounted thereon.

Tubing string 16 is supplied from drum 18 and is run between rollers 28 and 30. As tubing string 16 is unspooled from drum 18, generally it will pass adjacent to a measuring device, such as wheel 32. Alternatively, the measuring device may be incorporated in injector 20, such as described in U.S. Pat. No. 5,234,053 to Connell, assigned to the assignee of the present invention.

Rollers 28 and 30 define a pathway for tubing string 16 so that the curvature of the tubing is slowly straightened as it enters injector 20. There is enough play in rollers 28 and 30 to accommodate different-sized tubing diameters. As will be understood, tubing string 16 is preferably formed of a material which is sufficiently flexible and ductile that it can be curved for storage on drum 18 and later straightened. While the material is flexible and ductile, and will accept bending around a radius of curvature, it runs the risk of being pinched or suffering from fatigue failure should the curvature be severe. Rollers 28 and 30 are spaced such that straightening of the tube is accomplished so that the tubing is inserted into the well without kinks or undue bending.

Figure 3:
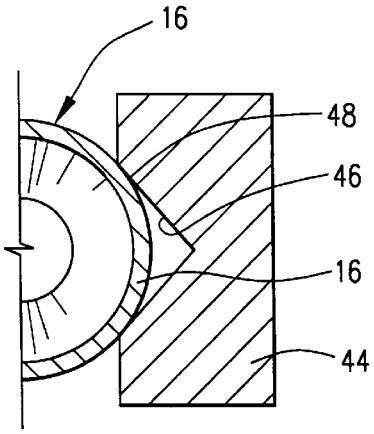
FIG. 3 is a cross section taken along lines 3—3 in FIG. 2.

Referring now to FIGS. 2 and 3, the details of the interaction between tubing string 16 and injector 20 will be discussed. Inside superstructure 24, a pair of gripper chains 34 and 35 are driven by a corresponding pair of gripper chain drive sprockets 36 and 37, respectively. Gripper chain drive sprockets 36 and 37 are mounted on drive shafts 38 and 39, respectively and driven thereby by a prime mover (not shown) in a manner known in the art. The lower portion of gripper chains 34 and 35 are supported by gripper chain idler sprockets 40 and 41, respectively mounted on idler shafts 42 and 43.

Gripper chains 34 and 35 are of a kind known in the art, and each has a plurality of outwardly facing tubing gripper blocks 44 thereon. As best seen in FIG. 3, each gripper block 44 has a V-shaped groove 46 defined on the outer face thereof. The V-shape of groove 46 allows the blocks to automatically adjust for different diameters on tubing string 16. That is, a larger outer surface 48 on tubing string 16 will be positioned further outwardly in groove 46 than a smaller diameter portion. Drive sprockets 36 and 37 and idler sprockets 40 and 41 are biased toward tubing string 16 in a manner known in the art so that gripper chains 34 and 35 generally conform to the outer surface of tubing string 16. As seen in FIG. 2, when tapered connector 10 passes through injector 20, gripper blocks 44 will grip along tapered outer surface 48 thereof. Gripper chains 34 and 35 are rotated in opposite directions so that the gripper blocks 44 on both which engage tubing string 16 move downwardly to force the tubing string into the well. This can be reversed to pull tubing string 16 out of the well. The V-shaped grooved surface of gripper blocks 44 in the Halliburton injector allow the differing outer surfaces of tubing string 16 to be substantially simultaneously engaged.

Figure 4:
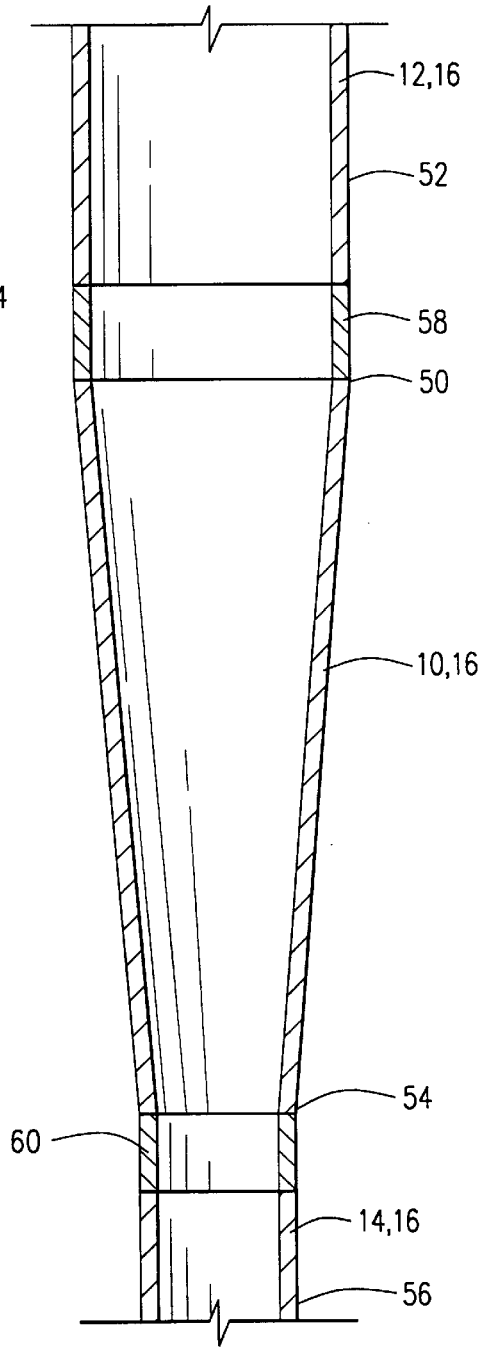
FIG. 4 is a longitudinal cross section of the tubing connector portion of the tubing string.

Referring now to FIG. 4, a cross section of the portion of tubing string 16 which includes tapered connector 10 is shown. Connector 10 is substantially conical in the preferred embodiment. Preferably, the maximum outer diameter 50 of tapered connector 10 is substantially the same as outside diameter 52 of first tubing section 12. Similarly, the minimum outside diameter 54 of connector 10 is substantially the same as outside diameter 56 of second tubing section 14. The upper end of tubing connector 10 is connected to first tubing section 12 by a first connector section 58, and the lower end of tapered connector 10 is attached to second tubing section 14 by a second connector section 60. In the illustrated embodiment, first and second tubing sections 12 and 14 and tapered connector 10 are metal, and first and second connector sections 58 and 60 are characterized by welded portions between tapered connection 10 and first and second tubing sections 12 and 14, respectively.

Alternatively, tapered connector 10 can have an internal nose that is integral thereto at each end. The noses are inserted into first and second tubing sections 12 and 14. The tubing sections then can be crimped or swaged onto the tapered connector. In still another embodiment, the tapered connector can be threadingly engaged with the first and second tubing sections 12 and 14. Tapered connector 10 and first and second tubing sections 12 and 14 may be made of a non-metallic composite material.

In any of the embodiments of tapered connector 10, the key feature is that the outer surface of tubing string 16 be relatively smooth so that tapered connector 10 provides a substantially even and gradual transition between first tubing section 12 and second tubing section 14. In this way, tubing connector 10 will pass smoothly through injector 20 and be substantially uninterruptedly engaged by gripper blocks 44 so that tubing string 16 is injected into the well.

If desired, multiple tubing sections having different diameters can be connected as described hereinafter to produce a tubing string for treating a well. For example, a larger outside diameter tubing at the top of a string may be connected to a smaller outside diameter tubing which in turn is connected to a yet smaller outside diameter tubing by multiple tapered connectors to reduce the hanging weight of the string and thereby reduce the yield loading on the tubing string upper sections.

It will be seen, therefore, that the tapered connector for a tubing string of the present invention is well adapted to carry out the ends and advantages mentioned as well as those inherent therein. While a presently preferred embodiment has been shown for the purposes of this disclosure, numerous changes in the arrangement and construction of parts may be made by those skilled in the art. All such changes are encompassed within the scope and spirit of the appended claims.

What is claimed is:

1. A tubing string for use with a tubing injector adapted for injecting tubing into a wellbore comprising:

a first tubing portion having a first tubing outside diameter;

a second tubing portion having a second tubing outside diameter which is different than said first tubing outside diameter; and a tapered portion disposed between said first and second tubing portions and comprising a first end having a first end outside diameter substantially equal to said first tubing outside diameter and a second end having a second end outside diameter substantially equal to said second tubing outside diameter, wherein said tapered portion is substantially incompressible.

2. The tubing string of claim 1 wherein said tapered portion is substantially conical.

3. The tubing string of claim 1 wherein said tapered portion is attached to said first and second portions by welding.

4. The tubing string of claim 1 wherein said first and second tubing portions and said tapered portion are made of a composite material.

5. The tubing string of claim 1 further comprising:

a first connector interconnecting said first tubing portion and said first end of said tapered portion; and a second connector interconnecting said second tubing portion and said second end of said tapered portion.

6. The tubing string of claim 5 wherein said first and second connectors are integrally formed with said tapered portion.

7. The tubing string of claim 5 wherein:

said first and second connectors are substantially cylindrical;

said first connector has a first connector outside diameter substantially equal to said first tubing outside diameter; and said second connector has a second connector outside diameter substantially equal to said second tubing outside diameter.

8. The tubing string of claim 5 wherein said first and second connectors are characterized by welds.

9. A method of running tubing in a wellbore comprising the steps of:

(a) providing a tubing string having an outer surface with a plurality of outside diameters, said tubing string having a tapered connector between adjacent portions of said tubing string having different outside diameters, wherein said tapered connector is substantially incompressible and provides a substantially even and gradual transition between said adjacent portions of said tubing string; and (b) injecting said tubing string in the wellbore by passing said tapered connector through a tubing injector.

10. The method of claim 9 wherein said injector is provided with a plurality of gripper blocks therein adapted for engaging said tapered connector and said different outside diameters of said tubing string as said tubing string is injected into the wellbore.

11. The method of claim 10 wherein said gripper blocks define a V-shaped groove in a side thereof facing said tubing string.

12. The method of claim 9 wherein said tapered connector and said tubing portions are made of a non-metallic composite material.

13. The method of claim 9 wherein step (a) comprises welding said tapered connector to said tubing portions.

14. A method of running tubing in a wellbore comprising the steps of:

(a) positioning a tubing injector adjacent to a wellhead at an upper end of the wellbore;

(b) positioning a tubing string through said injector, said tubing string being provided with an outer surface having a plurality of outside diameters and having a tapered connector between adjacent portions of said tubing string having different outside diameters, wherein said tapered connector is substantially incompressible and provides a substantially even and gradual transition between said adjacent portions of said tubing string; and (c) actuating said tubing injector for injecting said tubing string in the wellbore.

15. The method of claim 14 wherein step (b) further comprises welding said tapered connector to said adjacent portions of said tubing string.

16. The method of claim 14 wherein step (c) comprises passing said tapered connector through said injector.

17. The method of claim 14 wherein said tubing portions are made of a non-metallic composite material.

18. A tubing string for use with a tubing injector adapted for injecting tubing into a wellbore comprising:

a first tubing portion having a first tubing outside diameter;

a second tubing portion having a second tubing outside diameter which is different than said first tubing outside diameter; and a tapered portion disposed between said first and second tubing portions and comprising a first end having a first end outside diameter substantially equal to said first tubing outside diameter and a second end having a second end outside diameter substantially equal to said second tubing outside diameter, wherein said tapered portion is attached to said first and second portions by welding.

19. A tubing string for use with a tubing injector adapted for injecting tubing into a wellbore comprising:

a first tubing portion having a first tubing outside diameter;

a second tubing portion having a second tubing outside diameter which is different than said first tubing outside diameter;

a tapered portion disposed between said first and second tubing portions and comprising a first end having a first end outside diameter substantially equal to said first tubing outside diameter and a second end having a second end outside diameter substantially equal to said second tubing outside diameter;

a first connector interconnecting said first tubing portion and said first end of said tapered portion; and a second connector interconnecting said second tubing portion and said second end of said tapered portion, wherein said first and second connectors are integrally formed with said tapered portion.

20. A tubing string for use with a tubing injector adapted for injecting tubing into a wellbore comprising:

a first tubing portion having a first tubing outside diameter;

a second tubing portion having a second tubing outside diameter which is different than said first tubing outside diameter;

a tapered portion disposed between said first and second tubing portions and comprising a first end having a first end outside diameter substantially equal to said first tubing outside diameter and a second end having a second end outside diameter substantially equal to said second tubing outside diameter;

a first connector interconnecting said first tubing portion and said first end of said tapered portion, said first connector having a first connector outside diameter substantially equal to said first tubing outside diameter;

a second connector interconnecting said second tubing portion and said second end of said tapered portion, said second connector having a second connector outside diameter substantially equal to said second tubing outside diameter; and wherein said first and second connectors are substantially cylindrical.

21. A tubing string for use with a tubing injector adapted for injecting tubing into a wellbore comprising:

a first tubing portion having a first tubing outside diameter;

a second tubing portion having a second tubing outside diameter which is different than said first tubing outside diameter;

a tapered portion disposed between said first and second tubing portions and comprising a first end having a first end outside diameter substantially equal to said first tubing outside diameter and a second end having a second end outside diameter substantially equal to said second tubing outside diameter;

a first connector interconnecting said first tubing portion and said first end of said tapered portion; and a second connector interconnecting said second tubing portion and said second end of said tapered portion, wherein said first and second connectors are characterized by welds.

* * * * *